US006074182A

United States Patent [19]

Matson

[11] Patent Number: 6,074,182

[45] Date of Patent: Jun. 13, 2000

[54] DIRECT DRIVE FAN WITH X-SHAPED MOTOR MOUNTING

[75] Inventor: Carl G. Matson, Little Rock, Ark.

[73] Assignee: Triangle Engineering of Arkansas Inc., Jacksonville, Ark.

[21] Appl. No.: 09/040,865

[22] Filed: Mar. 18, 1998

[51] Int. Cl.[7] ..... F04B 17/00

[52] U.S. Cl. ..... 417/423.15; 417/423.14

[58] Field of Search ..... 417/423.14, 423.15, 417/360, 363; 416/100, 500, 244 R; 415/125

[56] References Cited

U.S. PATENT DOCUMENTS

| | | | |
|---|---|---|---|
| 3,112,852 | 12/1963 | Norden et al. | 225/104 |
| 3,943,728 | 3/1976 | Maudlin | 62/507 |
| 4,120,615 | 10/1978 | Kemm et al. | 417/360 |
| 4,200,257 | 4/1980 | Litch, III | 248/604 |
| 4,373,696 | 2/1983 | Dochterman | 248/604 |
| 4,482,124 | 11/1984 | Dochterman | 248/604 |
| 4,510,851 | 4/1985 | Sarnosky et al. | 98/42.08 |
| 4,594,940 | 6/1986 | Wolbrink et al. | 98/42.1 |
| 5,014,409 | 5/1991 | Hippach | 29/267 |
| 5,079,791 | 1/1992 | Grech | 7/169 |
| 5,186,605 | 2/1993 | Tracy | 415/119 |
| 5,348,447 | 9/1994 | Redetzke | 416/247 |
| 5,368,453 | 11/1994 | Peng | 417/423.5 |
| 5,474,427 | 12/1995 | Redetzke | 416/247 R |
| 5,480,282 | 1/1996 | Matson | 415/125 |
| 5,749,708 | 5/1998 | Matson | 416/247 R |

FOREIGN PATENT DOCUMENTS 575561 2/1946 United Kingdom .

*Primary Examiner*—Henry C. Yuen
*Assistant Examiner*—Mahmoud M. Gimie
*Attorney, Agent, or Firm*—Stephen D. Carver

[57] ABSTRACT

A direct drive cooling fan employs a specially configured, X-shaped mounting chassis to securely mount the drive motor. The preferred fan comprises a parallelepiped housing protectively enclosing an internal subframe securing a drive motor and a propeller. A reinforcing edge circumscribes the housing front and rear to facilitate guard coupling. The subframe comprises two parallel elongated brackets, each formed of channel material. Each strut comprises several regularly spaced apart follower slots to which the X-shaped mounting chassis is mounted. The preferred mounting chassis comprises a pair of complimentary brackets welded to opposite sides the drive motor shell. The brackets comprise a curved, interior cradle that flushly mates with the circumferential periphery of the drive motor. The brackets have wings at either end of the cradle terminating in tabs laying parallel with the subframe brackets. An attachment hole on each tab allows for the attachment of the mounting chassis to the subframe brackets. This attachment creates increased internal strength and allows for the torsional forces generated by the drive fan to be dissipated evenly throughout the fan housing. The diametrically aligned cradle wings form an X-shaped profile with the motor at the center.

2 Claims, 5 Drawing Sheets

DIRECT DRIVE FAN WITH X-SHAPED MOTOR MOUNTING

BACKGROUND OF THE INVENTION

1. Field of the Invention

The present invention relates generally to agricultural and industrial ventilation fans. More particularly, my invention relates to low-vibration ventilation fans of the type comprising fan blades that are directly connected to the drive motor.

2. Description of the Prior Art

It has long been recognized in the fan arts that moving air may be conveniently used to ventilate an area while simultaneously cooling it. A variety of fans are used extensively in agricultural facilities, especially in the poultry and dairy industries, to provide both ventilation and cooling.

To practically control the effects of wind or air cooling, it is desirable to control the direction, velocity, and volume of the air being driven. I have previously proposed a fan adept at controlling air over long ranges. My previous invention, issued as U.S. Pat. No. 5,480,282, on Jan. 2, 1996, and its teachings are hereby incorporated by reference. It was classified in U.S. Class 415, subclass 125. As can be seen from that patent and the prior art therein, the known prior art comprises many different types and designs of fans adapted to satisfy various criteria.

In the prior art it has been required to mount fans relatively close to the area to be cooled because the velocity of the expelled air drops dramatically as it leaves the fan. When expelled air leaves typical fans, extreme turbulence generated by the fan causes the expelled air to mix with surrounding air. The intermixing of the expelled air with the ambient air surrounding the fan results in a drop in volume, speed and pressure of the expelled air. This phenomena requires that the fan be mounted relatively close to the application it is to cool. It is often difficult to mount the fan as close as required to the application, in part because industrial-quality drive motors are very heavy, and the influence of vibration and extreme loads on the drive-train tends to degrade or loosen structural mounting parts over time.

To maximize the distance in which the fan will operate, the air must be concentrated and delivered properly for maximum effect. Concurrently, the fan must be properly mounted upon a suitable structure. It is also desirable to prevent workers from inadvertently contacting the fan, to avoid both mechanical and electrical injury. It is generally prohibited to mount fans with extension cords and other exposed electrical wiring.

Most industrial designs use a rectangular housing enclosing a multi-bladed fan that is belt driven at relatively high velocity. Such "tube axle" designs have several advantages. They are durable and rugged. They are relatively uncomplicated and easy to build. However, such fans can be noisy and they tend to vibrate, with vibration intensity often increasing over time. Loud, continuous rattles are annoying and distracting. Further, vibration can eventually loosen critical parts causing misalignment or premature breakdown. The long term structural durability of such fans is of paramount importance.

One cause of fan vibration relates to the "V-belts" or drive belts. In such fans the blade tip speed must be less than approximately one hundred miles per hour to minimize noise. Typically the fan speed is reduced from the motor speed by a ratio of three to one. This gear reduction results from the pulleys of various sizes connected by the V-belt. Over time typical V-belts will eventually wear and deform. Thereafter the tension transmitted by the belt between the axis of rotation of the fan blades and the drive motor axis will vary in response to rotation. An annoying oscillating effect can result. Unwanted vibration causes fan shaking and noise. Direct drive motors may ameliorate the problem of worn or distorted drive belts, and they reduce vibration and noise. But the motors in direct drive fans can be difficult to mount.

Another vexatious problem with conventional industrial fans involves structural deformation. Over time, internal stresses and dynamic forces generated during normal operation can misshape the fan, distorting the housing from the optimum round cross section. Many industrial fans are roughly moved about as necessary for spot cooling. Often these fans are mishandled, dropped, or subjected to other damaging forces through carelessness and the like. Known prior art fans are not designed to maximize structural strength. They fail to adequately compensate for stresses exerted by the motors and other internal components upon the housing during movement. Their guards fail to make a maximum contribution to structural integrity.

Finally, a problem with conventional fan housings involves the numbers of components that must be handled during assembly and maintenance. Conventional guards and guard attachment devices require handling and installing several parts during manufacture as well as removing a corresponding number during routine maintenance. Also, most conventional mounting brackets use several components pieces that require considerable assembly time. Such brackets are often difficult to handle and store.

The trend toward direct drive fans and their inherent simplicity has been the driving force to improve motors and their application to ventilating fans. In a direct drive ventilation fan the fan blades are rotated through direct contact with the drive motor. These direct drive motors turn at a slower speed than motors in conventional belt drive systems. For example, to obtain the correct blade speed for a 36 inch fan the direct drive motor need only turn 850 RPM. The conventional belt-driven fan, comprising a conventional capacitor start motor turning approximately 1750 RPM, requires two pulleys to divide the fan speed range down to approximately 500–800 RPM. Direct drive systems eliminate the complex speed reduction system. This greatly reduces the vibration and noise associated with conventional belt and pulley systems.

Conventional systems for mounting motors and engines has evolved around the need to support the center of the torque moment. In many industries large engines have mounting arrangements that isolate vibration and control torque with circular placement of isolation points. In some cases, several isolation mounts are located in a circular pattern to maintain shaft alignment and absorb torsional shock.

Small electric motors are available with concentric elastomeric mounting on each end of the motor to maintain concentricity and isolate vibration. Many mounting bases are offered as add-on isolation and belt-tensioners but do not maintain concentricity. Base mounted isolators by their very shape are unstable and allow harmonic movement, rendering them undesirable for close tolerance fan applications. Motor mounting for perfect concentricity and rigidity is well accomplished with the "C" face mounting. The "C" face motor requires an adapter plate to complete a mounting system for a fan. Any plate used for mounting also acts as an air deflector and causes turbulence that reduces the cooling effect of the air flow.

When motors are used to directly drive a fan blade it is desirable to have an unobstructed flow of air over the motor. Some fans have add-on flat mounting strips and lugs that allow attachment of flat plates which extend to the fan housing. These strips are mounted parallel with the air flow and obstruct the flow very little. Flat strips, however, and similar mounting methods tend to vibrate more than most arrangements. This type of mounting system must be limited to small motors.

Thus it is desirable to provide a fan with a highly efficient direct drive motor and a cooperating mounting system that provides a rigid support near the center line of the mass of the motor. Also it is desirable that the free flow of air over the motor housing be unobstructed.

SUMMARY OF THE INVENTION

My improved X-shaped motor mounting system greatly improves the operation of direct drive fans. My design overcomes several of the above referenced problems with known prior direct drive fans.

The fan preferably comprises a generally parallelepiped housing protectively enclosing several internal fan components. The fan components include an internal venturi fitting adjacent a vertically oriented mounting subframe. The subframe secures the fan shell inside the housing. A pair of detachable safety guards cover the front and rear housing faces.

The housing comprises a hollow, box-like frame separating an air intake end and a high output end. The frame has an open front and rear face bounding a parallel top and bottom and parallel side walls. A reinforcing edge circumscribes the frame adjacent each end. The edge comprises an angled brace adjacent to a top peripheral lip. The lip is perforated by several regularly spaced apart, elongated slits. Corresponding fastener orifices penetrate the frame walls adjacent to the slits.

Each guard comprises a wire mesh that prevents inadvertent contact with the internal fan components. Normally the guards may be removed to service the fan as necessary. The frame preferably encloses an internal venturi attached to the interior of the frame walls by screws or welds or other conventional securing devices. The subframe permanently attaches to the venturi and to the walls of the housing in a similar fashion.

The subframe comprises a pair of spaced apart, generally parallel elongated struts. The struts are preferably orientated vertically. Each strut is penetrated by several equidistantly spaced, elongated follower slots. The subframe secures the fan within the enclosure.

A unique, cross-shaped mounting chassis mounts the drive motor to the subframe. The motor is coaxially disposed adjacent spaced apart intake and outlet venturis. The motor directly drives and rotatably controls a conventional propeller to vigorously establish an airflow. The chassis comprises a pair of cooperating, wing-shaped brackets that terminate in suitable tabs for engaging the subframe struts. One bracket is welded to each side of the drive motor shell. The chassis is selectively positioned between the struts with appropriate fasteners that secure the tabs to suitable follower slots. The direct drive electrical motor is thus symmetrically mounted by the chassis between the struts, with the wing portions of the chassis brackets diametrically aligned to form an X-shaped appearance.

The parallel, vertical struts span the housing interior and rigidly support the motor without compromising the air flow. The mounting points at the distal ends along the radius of the cross-shaped mounting chassis connect to the support struts. The chassis legs and the subframe support struts form a brace for the support of the drive motor and the attached fan propeller blades. This brace transfers forces and stresses generated by the internal components during fan operation to the wheels and stand of the fan, which in turn dissipate the transferred forces and stresses to the support surface (i.e., the ground).

Thus a primary object of this invention is to provide a direct drive ventilation fan that maximizes airflow.

Yet another fundamental object of this invention is to provide a rigid mounting system for a direct drive ventilation fan.

Another important object is to provide a fan of the character described characterized by the efficiency of direct drive without the cost of reduction drive systems.

Another important object is to provide a direct drive ventilation fan for cooling applications that may be mounted in a variety of orientations.

Another object is to provide a direct drive fan of the character described that totally isolates all rotating blades within a safe, protected shroud to avoid direct human contact.

Another object is to provide a direct drive fan that provides a high volume of non-turbulent cooling air.

Another object is to provide a highly reliable fan system which moves the maximum amount of air possible through the minimum volume of fan.

Another important object is to provide a unique venturi effect that enables the fan to project air long distances.

A still further object is to provide a direct drive ventilation fan which is readily capable of use either inside or outdoors.

Yet another object of my fan is provide a direct drive ventilation fan that can be suspended from a ceiling or upon a wall.

Another object is to provide a direct drive ventilation fan which can cool a plurality of industrial workers, to minimize the number of fans which a company may need for proper cooling or ventilation.

A further object is to provide a direct drive ventilation fan which creates and expels a column of moving air as far as possible.

A major object is thus to provide a heavy duty direct drive ventilation fan that will not deform during operation.

Another fundamental object is to provide a direct drive ventilation fan that is highly stable.

Another object of this invention is to produce a direct drive fan of the character described that can be quickly assembled and whose parts, once assembled, synergistically reinforce the entire apparatus to prevent the fan from becoming "out-of-round."

Yet another object of the invention is to produce a direct drive ventilation fan of the character described whose construction details lead to higher manufacturing precision. It is a feature of the invention that the structure disclosed insures a consistent cylindrical shape and maintains a circular cross section.

Another important object is to provide a low vibration direct drive fan.

A related object of the present invention is to provide mounting chassis for the fan motor that dissipates internal forces and stresses to exteriorly braced housing components.

A related object of the present invention is to provide a mounting chassis for a direct drive fan motor that reduces air turbulence.

Yet another object is a fan that reduces noise and vibrations, thus lowering service costs.

Another important object is the exchange of a slow turning motor for a speed reducer thus eliminating the need for belt and gear maintenance.

A general object of this invention is to provide a fan of the character described which is easy to service in the field and which saves production time.

A still further object is to provide a fan which is readily capable of use either inside or outdoors.

Another object is to provide a fan of the character described that totally isolates all rotating blades within a safe, protected shroud to avoid direct human contact.

These and other objects and advantages of the invention, along with features of novelty appurtenant thereto, will appear and become apparent in the course of the following descriptive sections.

BRIEF DESCRIPTION OF THE DRAWINGS

In the following drawings, which form a part of the specification and which are to be construed in conjunction therewith, and in which like reference numerals have been employed throughout wherever possible to indicate like parts in the various views.

DETAILED DESCRIPTION OF THE DRAWINGS

Figure 1:
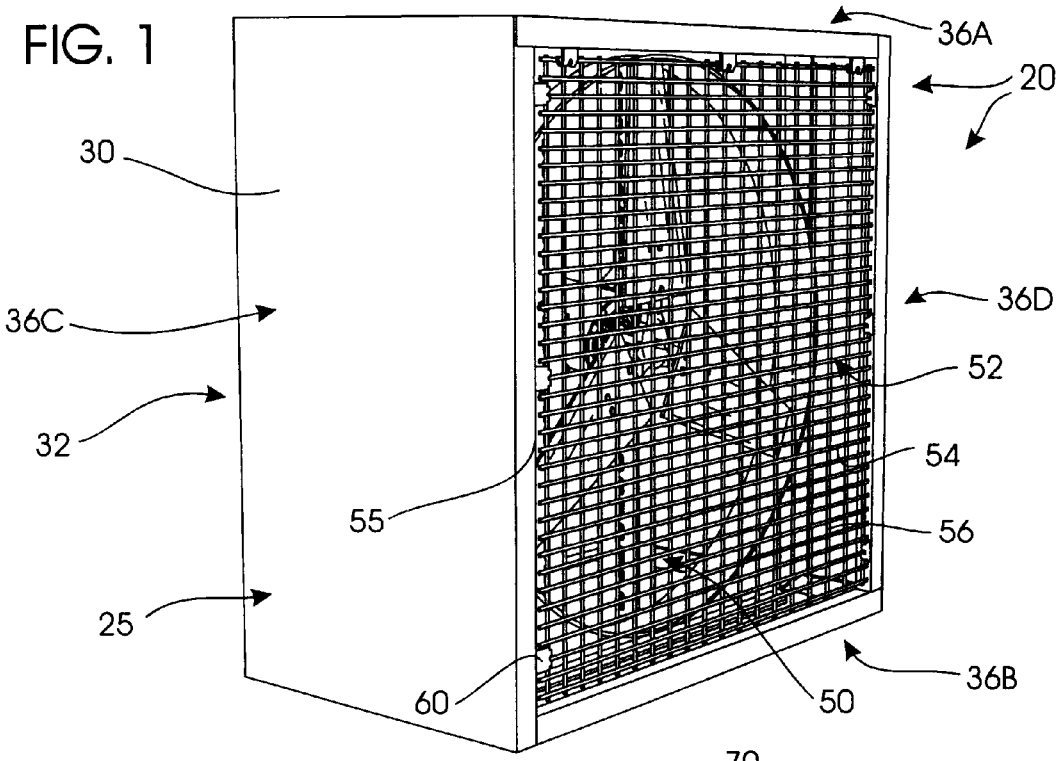
FIG. 1 is a frontal isometric view of a preferred mode of my new direct drive fan constructed in accordance with the best mode of the invention.

With initial reference directed to FIGS. 1–10, my improved fan assembly is generally designated by the reference numeral 20. An alternative embodiment (FIGS. 3, 4) is designated by the reference numeral 20A. As previously stated, improved fans 20, 20A overcome several problems inherent with prior art direct drive fans.

Figure 2:
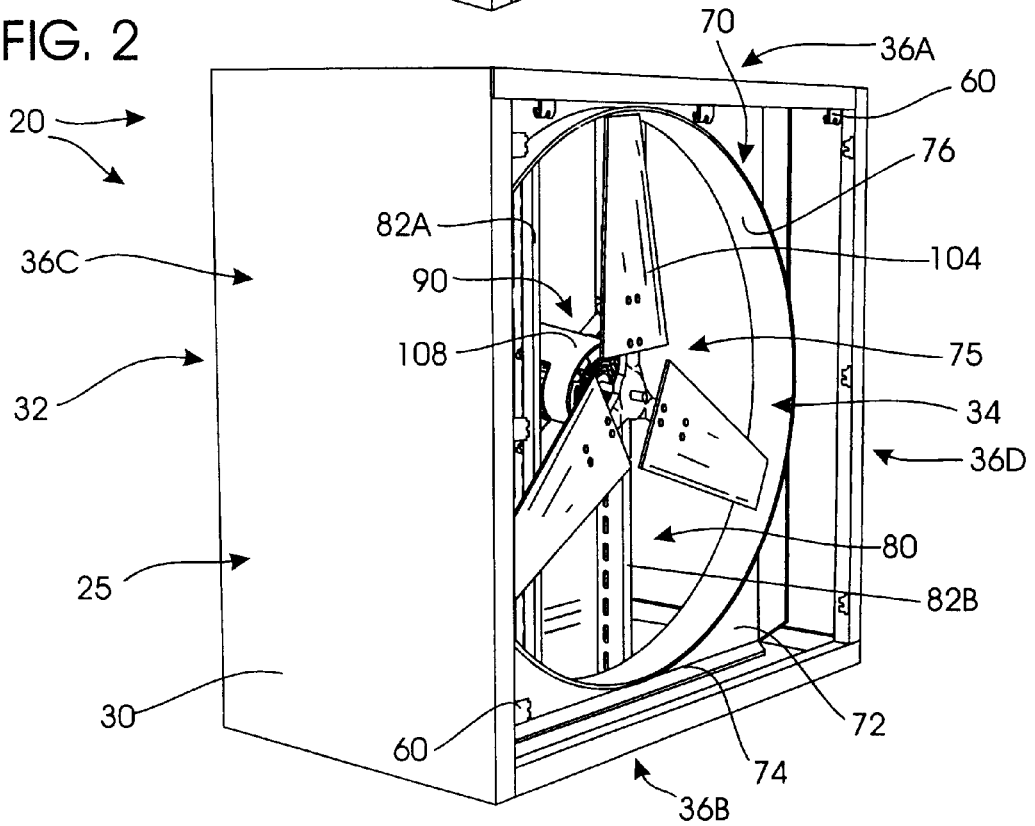
FIG. 2 is a partially fragmented, isometric view similar to FIG. 1, but with the front safety guard omitted for clarity.

With initial reference to FIGS. 1 and 2, fan 20 comprises a generally elongated, preferably tubular housing 25 defining an internal fluid flow channel for the passage of cooling air therethrough. Preferably, housing 25 comprises a generally cubicle frame 30. Frame 30 separates an air intake end 32 from a high velocity air output end 34. The frame 30 protectively encloses several internal fan components 75 including the motor, fan blades, etc. In the preferred embodiment, frame 30 comprises a rigid, parallelepiped, box-like assembly. Frame 30 has a spaced apart parallel top and bottom wall 36A and 36B and spaced apart parallel side walls 36C and 36D. Walls 36A–D cooperatively define a hollow, fluid flow channel therebetween.

A removable safety guard 50 substantially obscures each end 32,34. Guard 50 comprises a substantially rectangular wire mesh 52 that prevents inadvertent contact with the internal fan components 75. Wire mesh 52 comprises a series of inner, horizontal filamentary members 54 crossed by another series of vertical filamentary members 56. Thus, criss-crossed members 54 and 56 cooperatively form mesh 52. Members 54 and 56 are bounded by an integral peripheral outer member 55. Guard 50 is coupled to frame 30 by a plurality of selectively displaceable gripping clips 60.

The preferred fan 20 (FIGS. 1, 2) comprises a venturi fitting 70, mounting subframe 80, drive motor 108 and propeller 104. The venturi fitting 70 primarily comprises a funnel 72. Funnel 72 has a rectangular outer flanged periphery 74 and an interior, conic spout 76. The spout 76 compresses the input air into a high velocity output stream. The outer funnel periphery 74 is permanently attached to the walls 36A–D of the frame by screws or other conventional attachment devices.

The subframe 80 (FIGS. 7, 9) comprises a pair of spaced apart struts 82A, 82B that cooperatively support the cross-shaped mounting chassis 90. Struts 82A, 82B preferably extend between the frame top 36A and the bottom 36B adjacent venturi fitting 70. The preferably channel steel struts 82A, 82B each comprise an elongated, central planar portion 84A aimed towards the motor. An upturned edge 81A formed at the air intake side of the strut is parallel with a companion edge 81B at the opposite strut side. Edge 81B is integral with an inturned reinforcing lip 81C that is parallel with and spaced apart from portion 84A. A plurality of regularly spaced apart, oval follower slots 85 are formed in planar portion 84A to facilitate mounting and alignment. Offset mounting tabs 86 at the top and bottom of each strut are coplanar with edges 81B. Appropriate mounting orifices 87 are formed in each tab 86 for flush mounting to appropriate tabs within the fan housing.

The preferred X-shaped mounting chassis 90 (FIGS. 7, 9) comprises two similar brackets 92A and 92B placed on opposite sides of drive motor shell. The curved central cradle 200 of the bracket 90 conforms to the cylindrical periphery of the drive motor 108 (i.e., its shell). Each end of the cradle has an outwardly diverging wing 210 which terminates in an offset mounting tab 220. Preferably each tab 220 is generally parallel to the struts 82A, 84B. Mounting orifices 116 in tabs 220 register with strut orifices 85 to enable secure attachment of the chassis to the subframe 80. Fasteners comprising suitable mounting bolts 112 and hex nuts 114 are employed. Strut follower slots 85 and the cross-shaped mounting chassis attachment holes 116 are appropriately sized so that they may overlap. Such an overlap permits the chassis 90 to be infinitesimally adjusted along struts 82A, 82B to facilitate the use of a wide variety of propeller sizes as well as motor sizes.

In the alternative embodiment 20A (FIGS. 8, 10), frame 30A comprises a rigid, parallelepiped, box-like assembly. Frame 30A has spaced apart parallel top and bottom wall 37A and 37B and spaced apart parallel side walls 37C and 37*d*. Walls 37 A–D cooperatively enclose and support a hollow, fluid flow channel 83 therebetween.

A removable safety guard 50A substantially obscures each end 32A, 34A. Guard 50A comprises a substantially circular wire mesh 52A that prevents inadvertent contact with the internal fan components 75A. Wire mesh 52A comprises a series of outer, circular filamentary members 103 crossed by another series of radial filamentary members 101 and 107. Thus, criss-crossed members 103, 101 and 107 cooperatively form mesh 52A. Guard 50A is coupled to frame 30A by a plurality of removable bolts mounted through the distal ends of radial filamentary members 101.

The internal fan components principally comprise a venturi fitting 83, mounting subframe 80A, drive motor 108 and propeller 104. The venturi fitting 83 primarily comprises a transition zone 89 within the housing 30A where the diameter of the flared end 79A gradually reduces and smoothly merges with the uniform diameter of the venturi 83. Propeller 104 is attached to the drive motor 108. The propeller and motor assembly is mounted within the transition zone to produce a stable high velocity output stream of air.

The subframe 80A (FIGS. 8, 10) primarily comprises a pair of spaced apart struts 83A, 83B that support the cross-shaped mount chassis 90. Channel-like struts 83A, 83B extend between the top and the bottom of venturi fitting 83. Struts 83A and 83B are similar to struts 82A and 82B previously discussed. Central strut portions 100 are bounded by opposite edges 102 at each side that include inturned lips 102A that are parallel with body portions 100. Regularly spaced apart follower slots 85 facilitate assembly and mounting.

Figure 3:
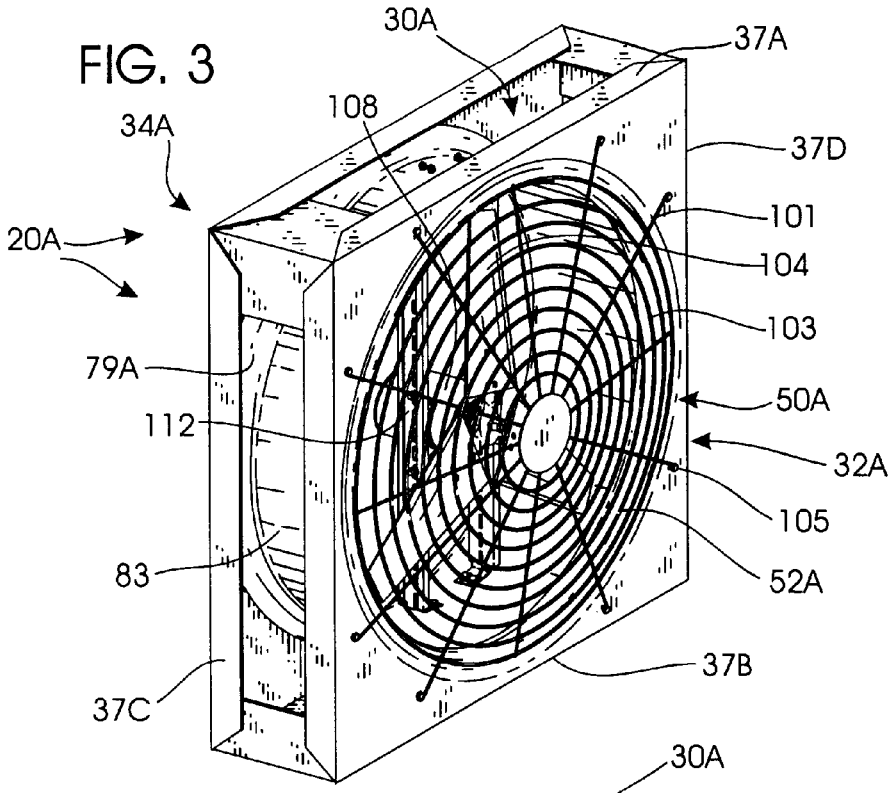
FIG. 3 is an isometric view of an alternative embodiment employing a different housing assembly requiring a modified subframe assembly.
Figure 4:
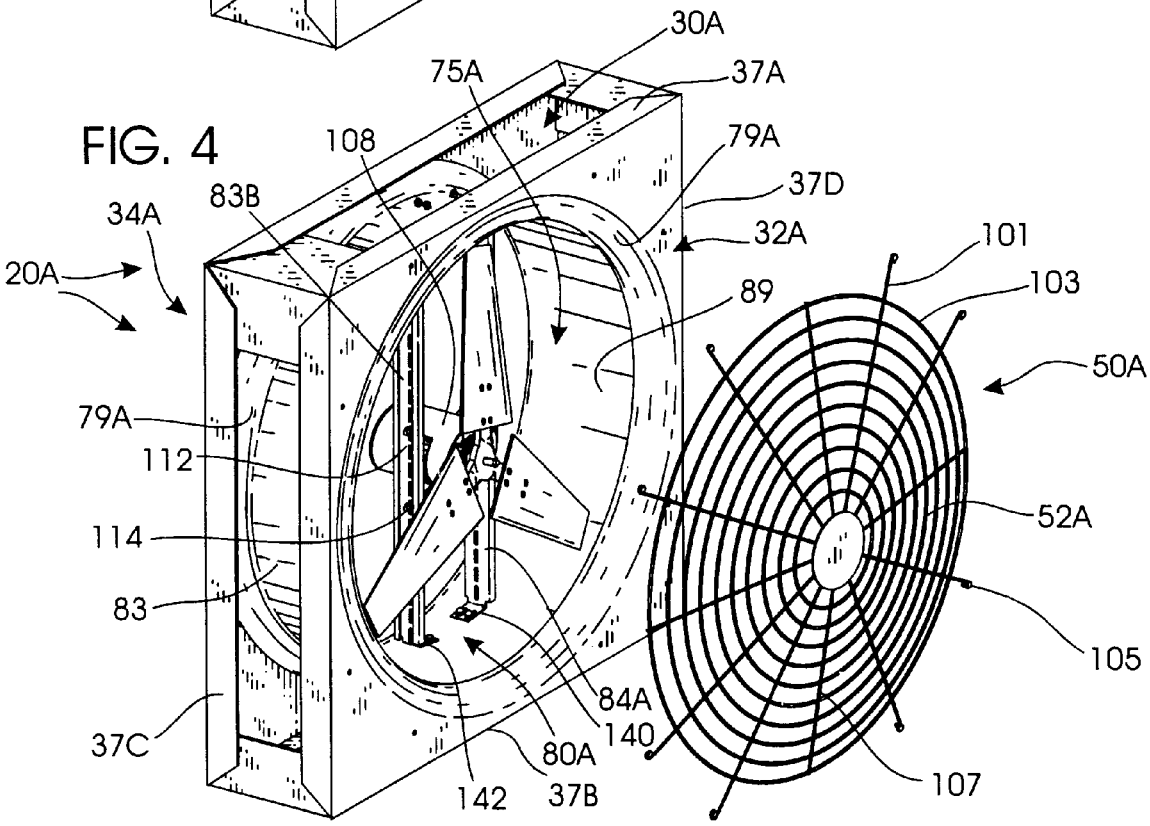
FIG. 4 is a partially exploded, isometric view of the fan of FIG. 3.
Figure 5:
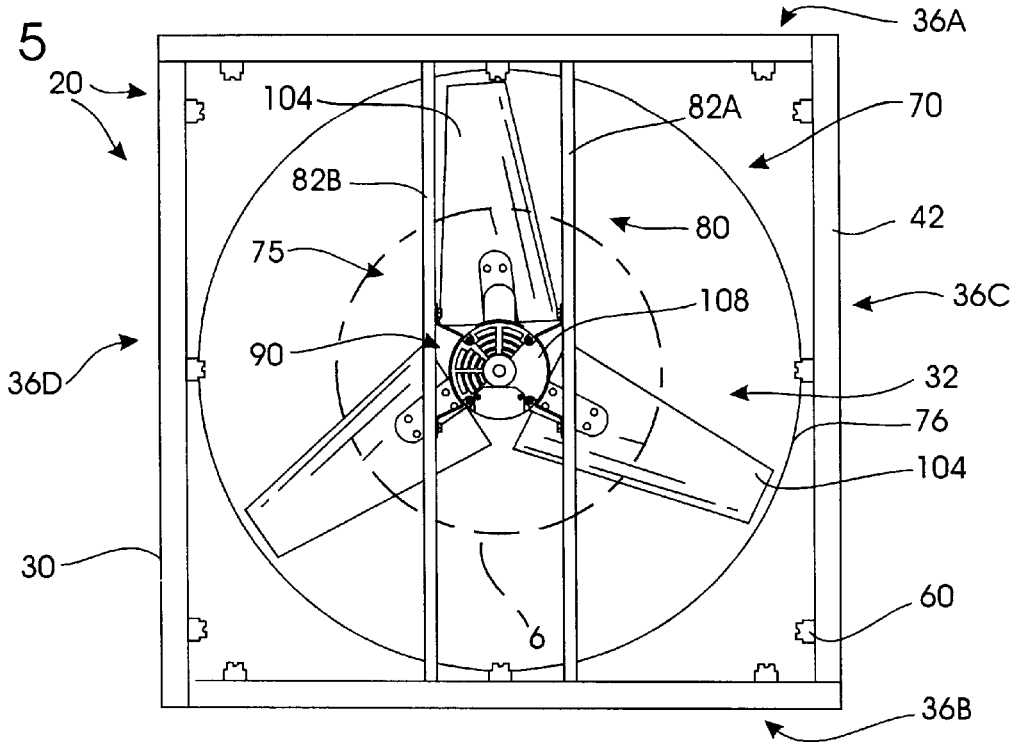
FIG. 5 is a partially fragmented, rear elevational view taken generally from the rear of FIG. 1.
Figure 6:
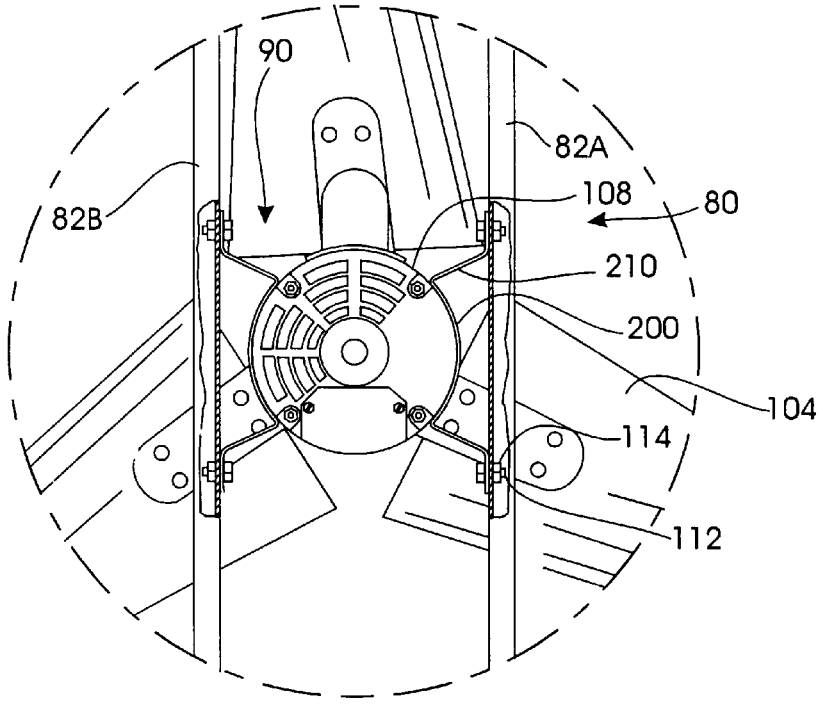
FIG. 6 is a partially fragmented, enlarged elevational view taken generally from encircled region 6 in FIG. 5.
Figure 7:
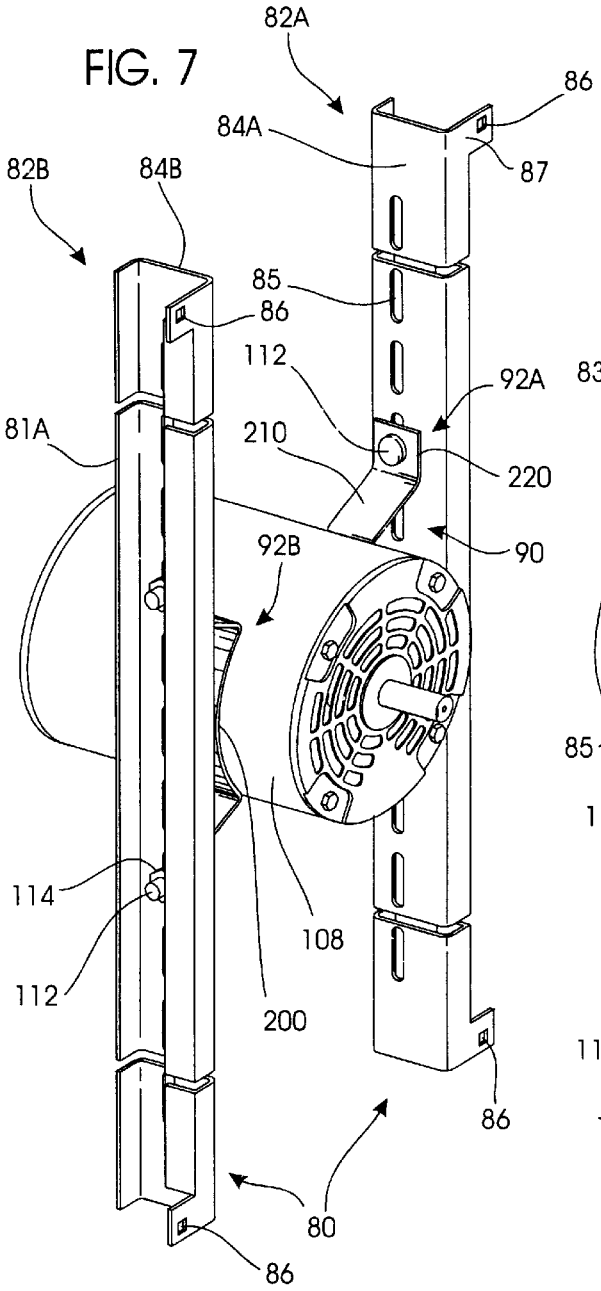
FIG. 7 is a enlarged fragmentary isometric view of the subframe assembly of the first embodiment, with portions omitted or broken away for clarity.
Figure 8:
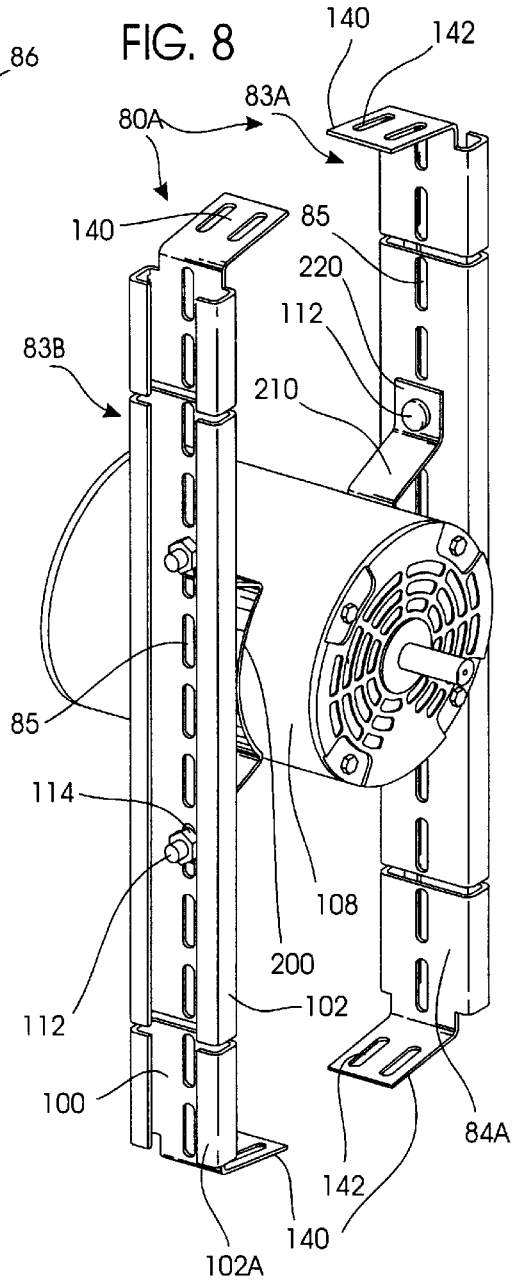
FIG. 8 is a enlarged fragmentary isometric view of the subframe assembly of the second embodiment, with portions omitted or broken away for clarity.
Figure 9:
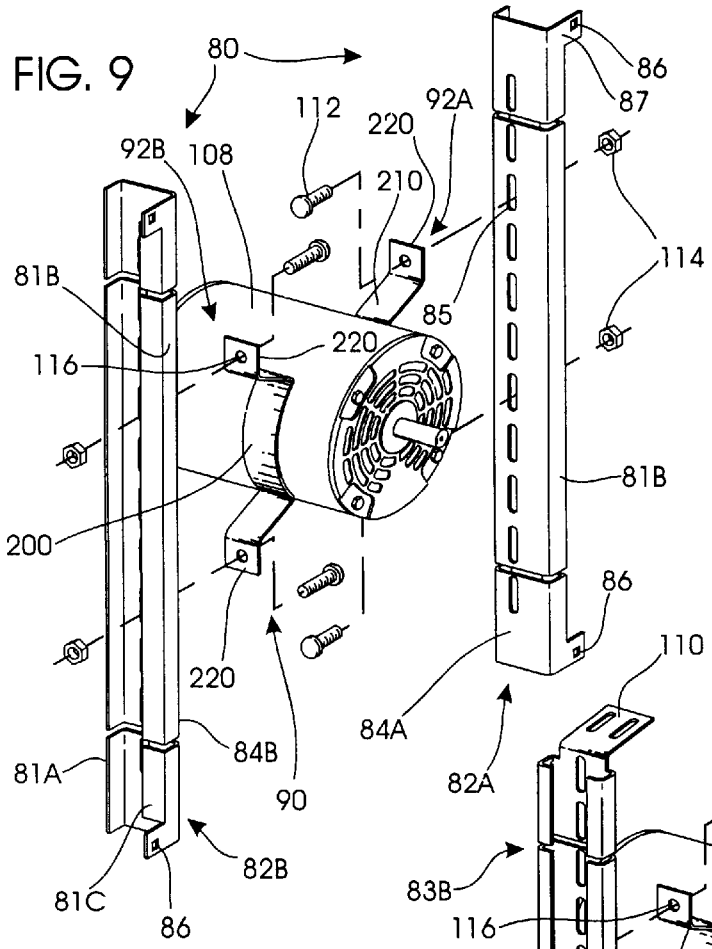
FIG. 9 is a enlarged exploded isometric view of first embodiment subframe assembly, with portions omitted or broken away for clarity.
Figure 10:
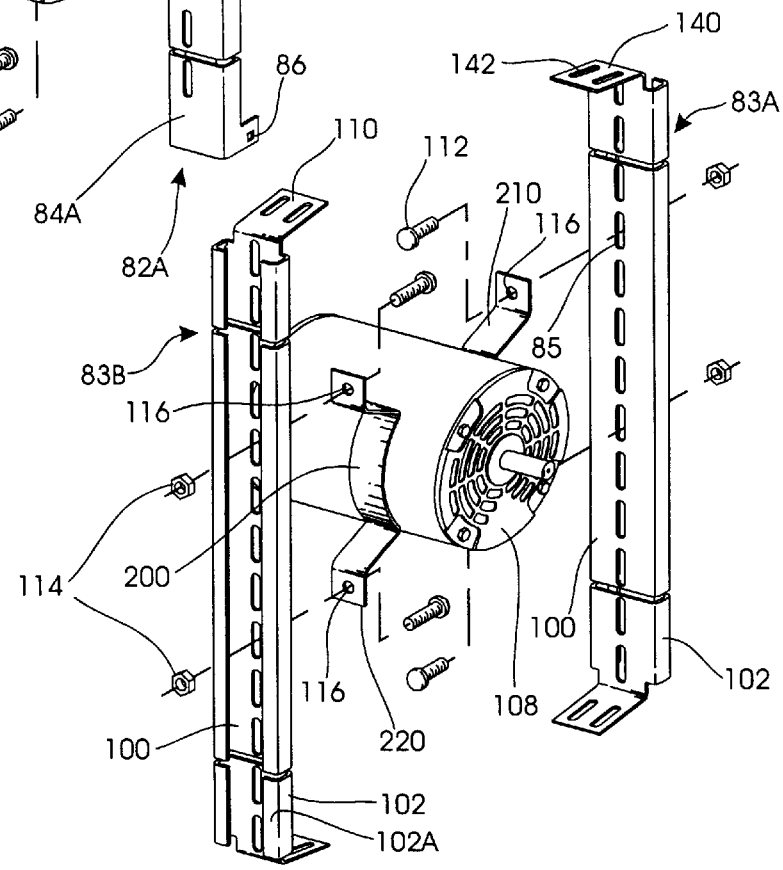
FIG. 10 is a enlarged, exploded isometric view of the second embodiment subframe assembly, with portions omitted or broken away for clarity.

A transverse foot 140 is formed at each end of the struts 83A, 83B (FIGS. 8, 10). Feet 140 occupy a plane that is generally perpendicular to the plane occupied by central strut portions 100. Each foot 140 comprises a pair of parallel mounting orifices 142 for attachment to the internal circumferential boundary of the venturi 83 (FIG. 3).

From the foregoing, it will be seen that this invention is one well adapted to obtain all the ends and objects herein set forth, together with other advantages which are inherent to the structure.

It will be understood that certain features and subcombinations are of utility and may be employed without reference to other features and subcombinations. This is contemplated by and is within the scope of the claims.

As many possible embodiments may be made of the invention without departing from the scope thereof, it is to be understood that all matter herein set forth or shown in the accompanying drawings is to be interpreted as illustrative and not in a limiting sense.

What is claimed is:

1. An low-vibration direct drive fan comprising:

a housing comprising an interior, an air intake end, a spaced apart air output end;

a propeller disposed within said housing;

direct drive motor means for rotating the propeller, said motor means comprising a generally cylindrical shell; and, means for securely mounting said direct drive motor means within said housing, said mounting means comprising:

a pair of rigid, spaced apart, mounting struts extending through the housing interior; and a chassis symmetrically coupled to said shell for securing the motor means to said struts, said chassis comprising a pair of brackets each comprising a central cradle portion flushly nested against the shell, and a pair of integral wings diverging outwardly from the cradle and terminating in tabs fastened to said struts, wherein the outwardly diverging wings at each end of the two cradles present an X-shaped profile, and the motor means is centrally disposed between the brackets at the center of the chassis.

2. A ventilation fan comprising:

an elongated, tubular, rigid housing adapted to be remotely disposed and aimed at a target, said housing comprising an interior, an exterior, an air intake end, a spaced apart high velocity air output end;

means for securing said fan upon a supporting structure;

a propeller disposed within said housing;

direct drive motor means for rotating the propeller to establish an airflow between the air intake end and air output end, the motor means comprising a generally cylindrical outer shell having an outer periphery;

a pair of rigid, spaced apart, parallel struts extending vertically within said interior;

X-profile chassis means for mounting the motor between the struts to reduce turbulence and thus increasing fan efficiency, wherein said chassis means is symmetrically coupled to said motor means, said chassis means comprising a pair of brackets, each bracket comprising a central cradle portion flushly nested against at least a portion of the outer periphery of the motor means, with the motor means centrally disposed between the brackets at the center of the chassis means; and, wherein the struts comprise a plurality of spaced-apart mounting orifices, and the brackets comprise outwardly diverging wings terminating in tabs adapted to be coupled to said struts.

* * * * *